US005921005A

United States Patent [19]

Bell et al.

[11] Patent Number: 5,921,005

[45] Date of Patent: Jul. 13, 1999

[54] SELF-ADJUSTING TRACTION-ALTERING ATTACHMENT DEVICE FOR FOOTWEAR

[75] Inventors: Michael Bell, 758 Rydal Green Dr., Rydal, Pa. 19046; Jonathan Marc Bell, Maple Glen; Eric P. Bell, Philadelphia, both of Pa.

[73] Assignee: Michael Bell, Rydal, Pa.

[21] Appl. No.: 09/056,013

[22] Filed: Apr. 7, 1998

Related U.S. Application Data

[63] Continuation-in-part of application No. 09/012,108, Jan. 22, 1998.

[51] Int. Cl.[6] ..... A43B 23/28; A43B 3/10

[52] U.S. Cl. ..... 36/59 R; 36/15; 36/7.6; 36/11.5

[58] Field of Search ..... 36/7.5, 7.6, 7.7, 36/11.5, 15, 100, 101, 59 R

[56] References Cited

U.S. PATENT DOCUMENTS

| | | | |
|---|---|---|---|
| 1,032,600 | 7/1912 | Grout . | |
| 1,088,309 | 2/1914 | Weidt | 36/11.5 |
| 1,716,790 | 6/1929 | Mitchell . | |
| 1,747,603 | 2/1930 | Ruth . | |
| 1,877,080 | 9/1932 | Teshima . | |
| 2,076,316 | 4/1937 | Beals, Jr. . | |
| 2,189,489 | 2/1940 | Fritz | 36/11.5 |
| 2,361,972 | 11/1944 | Smith . | |
| 2,408,152 | 9/1946 | Porcelli . | |
| 2,596,188 | 5/1952 | Webb | 36/11.5 |
| 2,617,209 | 11/1952 | Jackson . | |
| 2,628,437 | 2/1953 | Forsythe . | |
| 2,801,478 | 8/1957 | Gilbert . | |
| 3,012,343 | 12/1961 | Dinkel . | |
| 3,040,451 | 6/1962 | Hilkemeyer . | |
| 3,214,850 | 11/1965 | McNair . | |

(List continued on next page.)

OTHER PUBLICATIONS

"Easy–Wear Ice Cleats" sold by Carole Martin Gifts of Champlain NY.

"Spiky Slip Protection On Ice And Snow" sold by G.W.Russell & Associates, Ltd. of Allentown, PA.

"Rud Shoe Chain" sold by RUD–Kettenfabrik Rieger & Dietz of Germany.

A catalog page showing a "68 300 . . . Spiky plus," a "C/68 301 . . . Conti–Spiky," and a "A/68 310 00 Rud Quickstep" non–slip footwear attachments.

*Primary Examiner*—M. D. Patterson

*Attorney, Agent, or Firm*—Caesar, Rivise, Bernstein, Cohen & Pokotilow, Ltd.

[57] ABSTRACT

A footwear attachment device for releasable mounting on primary footwear, e.g., a boot or shoe, to provide enhanced traction. The primary footwear has an upper including a toe portion and a heel portion, a sole including a fore-foot portion and a heel portion. The attachment device comprising an integral member having a mounting ring and plural stretchable connecting webs, extending between respective portions of the ring. The attachment device also includes a forefoot pad assembly and a heel pad assembly. Each pad assembly includes a generally planar base pad and a generally planar a cover pad. Each base pad includes a recess for receipt of a respective one of the connecting webs. Each cover pad is arranged to be secured over an associated base pad with the connecting web interposed therebetween and stretchable in the recess. Each base pad includes a ground engaging surface. Each cover pad includes an inner surface. The ring is stretchable to enable it to encircle the upper of the primary footwear to releasably mount it, so that the inner surface of one of the pad assemblies is engagement with the forefoot portion of the sole of the primary footwear, and the inner surface of the other pad assembly is in engagement with the heel portion of that sole. The ground engaging surface of each pad assembly may comprise ridges, grooves, cleats or combinations thereof, for providing a desired type of traction. A pull tab is also provided on the ring to facilitate the mounting of the ring on the primary footwear.

29 Claims, 10 Drawing Sheets

U.S. PATENT DOCUMENTS

| | | | |
|---|---|---|---|
| 3,229,389 | 1/1966 | Adams . | |
| 3,516,181 | 6/1970 | Jordan . | |
| 3,609,888 | 10/1971 | Rickman . | |
| 3,902,259 | 9/1975 | Cracco | 36/11.5 |
| 4,302,890 | 12/1981 | Covell et al. . | |
| 4,344,238 | 8/1982 | Peyser . | |
| 4,353,172 | 10/1982 | Bryant . | |
| 4,525,939 | 7/1985 | McNeil et al. . | |
| 4,727,662 | 3/1988 | Ilon . | |
| 4,807,372 | 2/1989 | McCall . | |
| 4,910,883 | 3/1990 | Zock, Jr. . | |
| 4,924,608 | 5/1990 | Mogonye . | |
| 5,341,582 | 8/1994 | Liautaud . | |
| 5,359,789 | 11/1994 | Bell | 36/7.6 |
| 5,485,687 | 1/1996 | Rohde . | |
| 5,813,143 | 9/1998 | Bell et al. | 36/59 R |
| 5,842,290 | 12/1998 | Mills | 36/7.5 |

FIG. 13
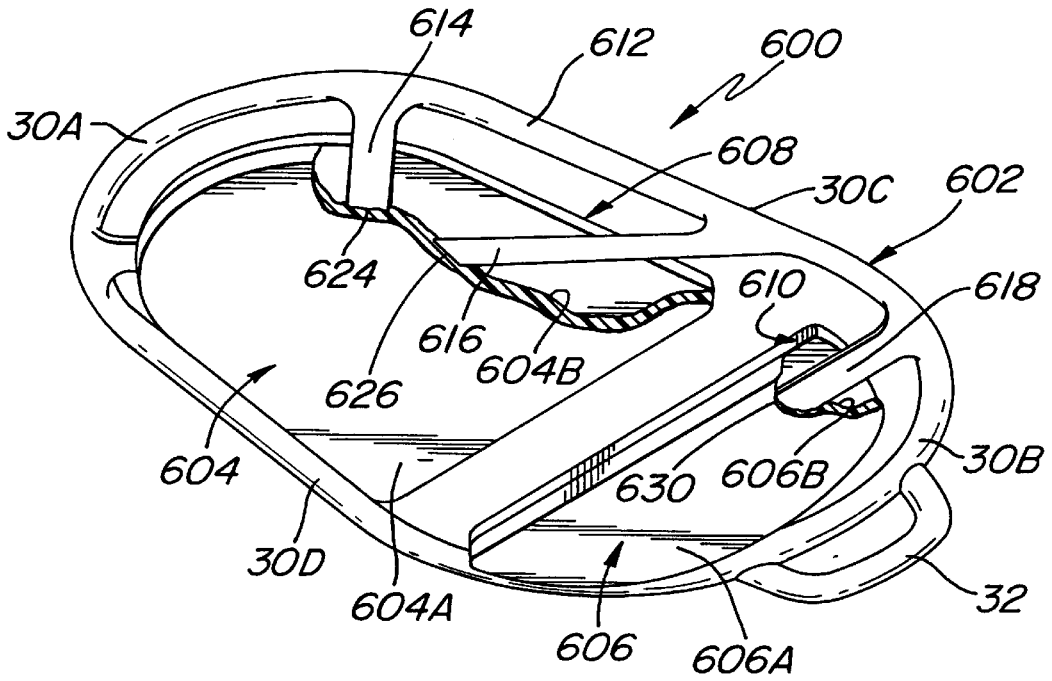
FIG. 15
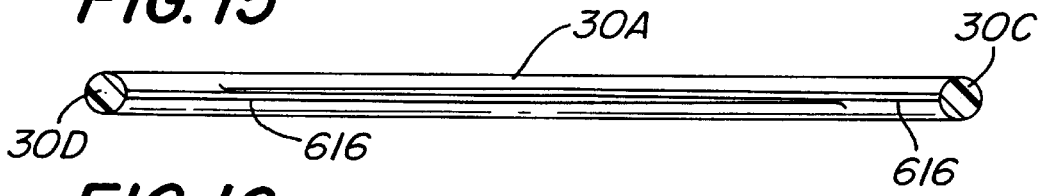
FIG. 16
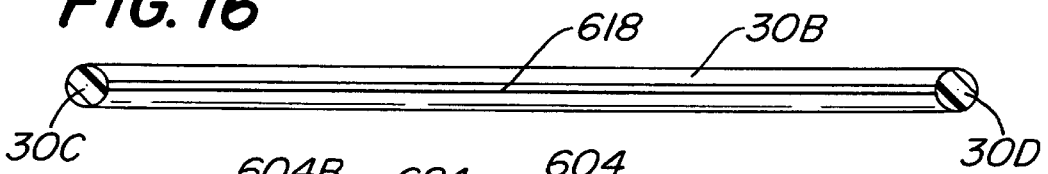
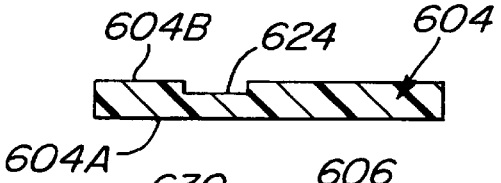
FIG. 18
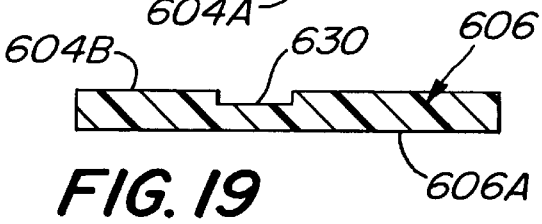
FIG. 19
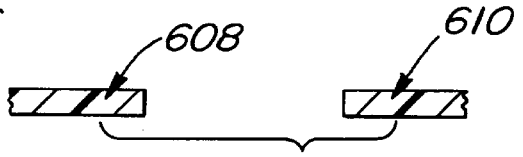
FIG. 21

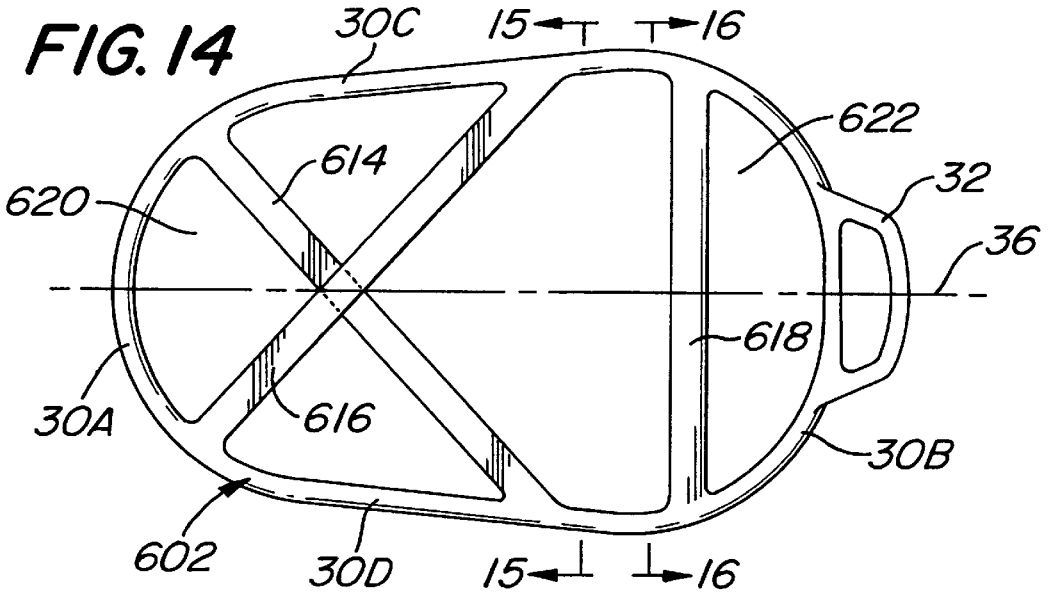
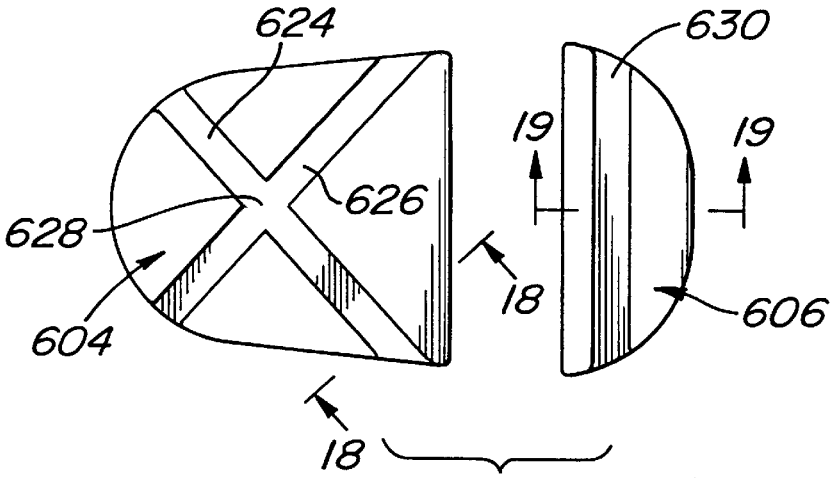
FIG. 17
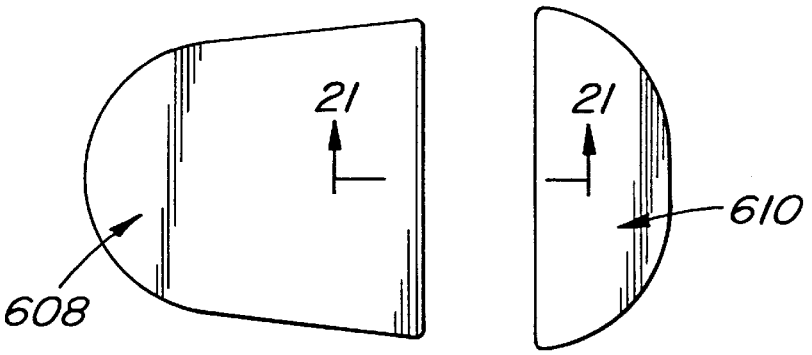
FIG. 20

608
610
32
602
618
616
30B
614
30A
606B
606
604B
604
628
630
606A
626
624
604A

SELF-ADJUSTING TRACTION-ALTERING ATTACHMENT DEVICE FOR FOOTWEAR

Related Application

This application is a Continuation-In-Part of our earlier application Ser. No. 09/012,108, filed on Jan. 22, 1998, entitled Traction Altering Attachment Device With Resilient Mounting Ring For Use On Footwear, which application is assigned to the same assignee as this invention and whose disclosure is incorporated by reference herein.

BACKGROUND OF THE INVENTION

This application relates generally to footwear and more particularly to attachments which are adapted to be stretched over a portion of the upper of an article of primary footwear, e.g., a shoe or boot, so that a portion of it is on the sole/heel of primary the primary footwear to alter the amount of ground engaging traction provided thereby, e.g., to enhance the traction to provide increased resistance to slippage.

Various ice gripping, sandal-like, attachments for footwear are commercially and have been disclosed in the patent literature, Examples of such patented devices are found in the following U.S. Letters Pat. Nos.: 1,032,600 (Grout); 2,361,972 (Smith); 3,214,850 (McNair); 3,516,181 (Jordan); 4,344,238 (Peyser); 4,353,172 (Bryant); 4,525,939 (McNeil et al.); and 4,910,883 (Zock, Jr.).

There are also some spike or cleat-bearing attachments which are commercially available for use on footwear to prevent slippage on ice or other slippery surfaces. One such type of attachment is sold under the trademark "RUD Shoe Chain" and is a rubber ring having chains extending between opposed portions of the ring. The rubber ring is arranged to be stretched over the upper of a boot or shoe so that the chains extend under the sole and heel to provide traction on ice and snow.

Another type of attachment is sold under the trademark SPIKY and is in the form of a resilient rubber sling or overshoe having plural metal spikes or cleats on the bottom thereof and which are arranged to dig into ice when the attachment is worn over an article of primary footwear, e.g., a boot or shoe.

While the aforementioned prior art devices are generally suitable for their intended purposes, they still leave something to be desired fiom various standpoints, such as simplicity of construction, compactness, ease of mounting and removing, integrity of components and effectiveness.

Other prior art attachment devices for footwear are shown in the following U.S. Letters Pat. Nos.: 1,877,080 (Teshima), 2,076,316 (Beals, Jr.), 2,617,209 (Jackson), 2,628,437 (Forsythe), 3,012,343 (Dinkel), 3,040,451 (Helkemeyer), 3,609,888 (Rickman), 4,807,372 (McCall), 4,302,890 (Covell et al.), 4,727,662 (Ilon), 5,485,687 (Rohde), and 5,341,582 (Liautand).

In the parent application to this application there is disclosed and claimed a footwear attachment device for releasable mounting on primary footwear, e.g., a boot or shoe, to provide enhanced traction. The primary footwear has an upper including a toe portion and a heel portion, a sole including a fore-foot portion and a heel portion. The attachment device is in the form of an integral member having a mounting ring, a forefoot-sole engaging portion, a heel-sole engaging portion, and plural connecting webs and is preferably molded of a resilient material. The forefoot-sole engaging portion and the heel-sole engaging portion of that device are each generally planar members mounted within the bounds of the ring by the connecting webs. The ring is stretchable to enable it to encircle the upper of the primary footwear to releasably mount it, so that its forefoot-sole engaging portion is engagement with the forefoot portion of the sole of the primary footwear, and the heel-sole engaging portion is in engagement with the heel portion of that sole. The forefoot-sole portion and the heel-sole portion of the attachment device each have a ground engaging surface, e.g., ridges, grooves, cleats or combinations thereof, for providing a desired type of traction. A pull tab is also provided on the ring to facilitate the mounting of the ring on the primary footwear.

While the foregoing device is suitable for its intended purposes it may leave something to be desired from the standpoints of accommodating various sizes and shapes of primary footwear on which it is to be mounted, and resistance to accidentally becoming dismounted from that footwear.

OBJECTS OF THE INVENTION

Accordingly, it is a general object of this invention to provide an attachment device for use on primary footwear, e.g., a boot, shoe, etc., which overcomes the disadvantages of the prior art.

It is another object of this invention to provide an attachment device for primary footwear including a ground engaging portion and a resilient mounting ring to enable the device to be releasably mounted on the primary footwear.

It is another object of this invention to provide an attachment device for primary footwear including a ground engaging portion and a resilient mounting ring for releasably mounting the device on the primary footwear and when so mounted is resistant to accidental dismounting.

It is another object of this invention to provide an attachment device for primary footwear which is arranged to be easily mounted on the primary footwear and easily removed therefrom, yet is resistant to accidental dismounting.

It is another object of this invention to provide an attachment device for primary footwear which includes a ground engaging portion to provide some desired type of engagement with the ground not provided by the primary footwear, such as general slip resistance, specific (e.g., lateral) slip resistance, low friction, etc.

It is yet another object of this invention to provide an attachment device for primary footwear which is simple in construction.

It is yet another object of this invention to provide an attachment device for primary footwear which can be readily manufactured.

It is yet another object of this invention to provide an attachment device for primary footwear which when not in use assumes a flat, compact state but which can be rolled up, if desired.

It is yet another object of this invention to provide an attachment device for primary footwear which includes portions which are removable to convert the attachment to a desired type of traction altering device.

SUMMARY OF THE INVENTION

These and other objects of the subject invention are achieved by providing a footwear attachment device for releasable mounting on a primary footwear to provide a desired type of traction, e.g., enhanced traction. The primary footwear has an upper and a sole including a fore-foot portion and a heel portion. The attachment device comprising an integral mounting member, at least one base pad member, and at least one cover pad member.

The mounting member basically comprises a mounting ring and plural connecting webs extending between selected portions of said ring, e.g., a pair of elongated straps intersecting each other and extending between respective portions of the ring in the forefoot region thereof and a transversely extending strap extending between respective portions of the ring in the heel region. The mounting member is preferably molded of a resilient material.

The base pad member, e.g., a planar flexible sheet, includes at least one recess in it for receipt of a respective one of the connecting webs of the integral mounting member. The cover pad member, e.g., also a planar flexible sheet, is arranged to be secured, e.g., glued, over the base pad member with a respective one of the connecting webs of the integral mounting member being interposed between the base pad member and the cover pad member and being stretchable within the recess. One of the pad members has an inner surface and the other of the pad members has a ground engaging surface, which may be of any suitable configuration, e.g., ridges, grooves, cleats, etc.

The ring is stretchable to enable it to encircle the upper of the primary footwear to releasably mount the attachment device thereon, with the inner surface of one of said pad members being disposed in engagement with a portion of the sole of the primary footwear, and with the ground engaging surface being exposed for providing a desired type of traction.

DESCRIPTION OF THE DRAWING

Other objects and many attendant features of this invention will become readily appreciated as the same becomes better understood by reference to the following detailed description when considered in connection with the accompanying drawing wherein:

FIG. 13 is an isometric view, like FIG. 2, but showing still another alternative embodiment of an attachment device of this invention;

FIG. 14 is a reduced plan view of a portion of the device shown in FIG. 13;

FIG. 15 is an enlarged sectional view taken along line 15—15 of FIG. 14;

FIG. 16 is an enlarged sectional view taken along line 16—16 of FIG. 14;

FIG. 17 is a plan view of other portions of the device shown in FIG. 13;

FIG. 18 is an enlarged sectional view taken along line 18—18 of FIG. 17;

FIG. 19 is an enlarged sectional view taken along line 19—19 of FIG. 17;

FIG. 20 is a plan view, like that of FIG. 17, but showing still other portions of the device shown in FIG. 13;

FIG. 21 is an enlarged sectional view taken along line 21—21 of FIG. 20.

DETAILED DESCRIPTION OF THE PREFERRED EMBODIMENTS

Figure 1:
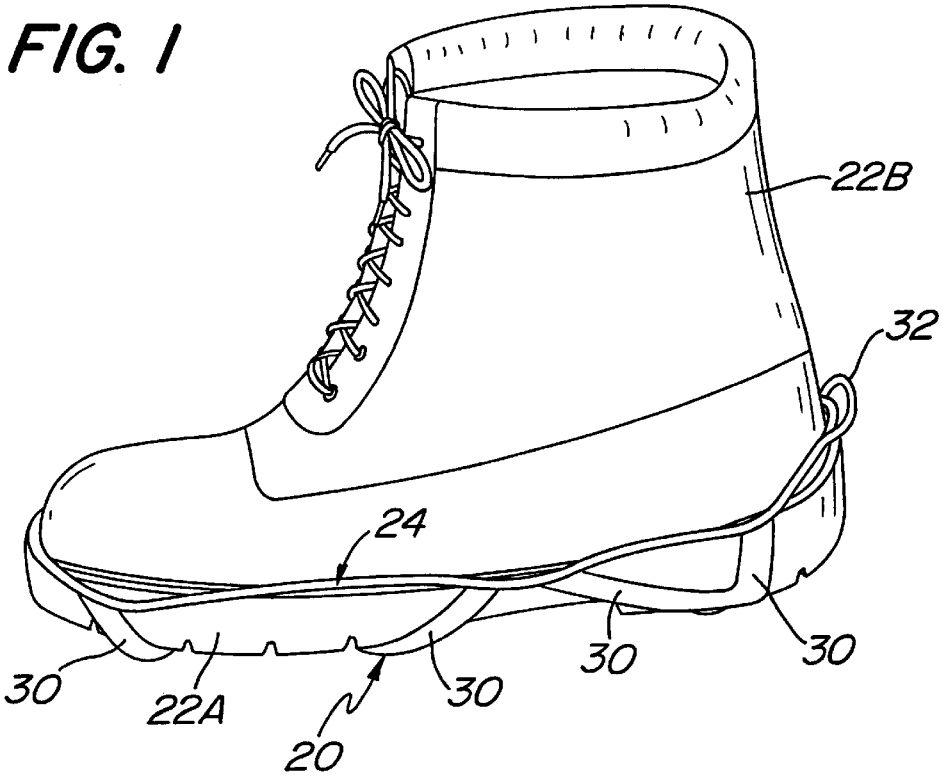
FIG. 1 is an isometric view of one embodiment of the attachment device of the subject invention shown in use mounted on a conventional primary footwear, e.g., a boot, to provide enhance traction.
Figure 9:
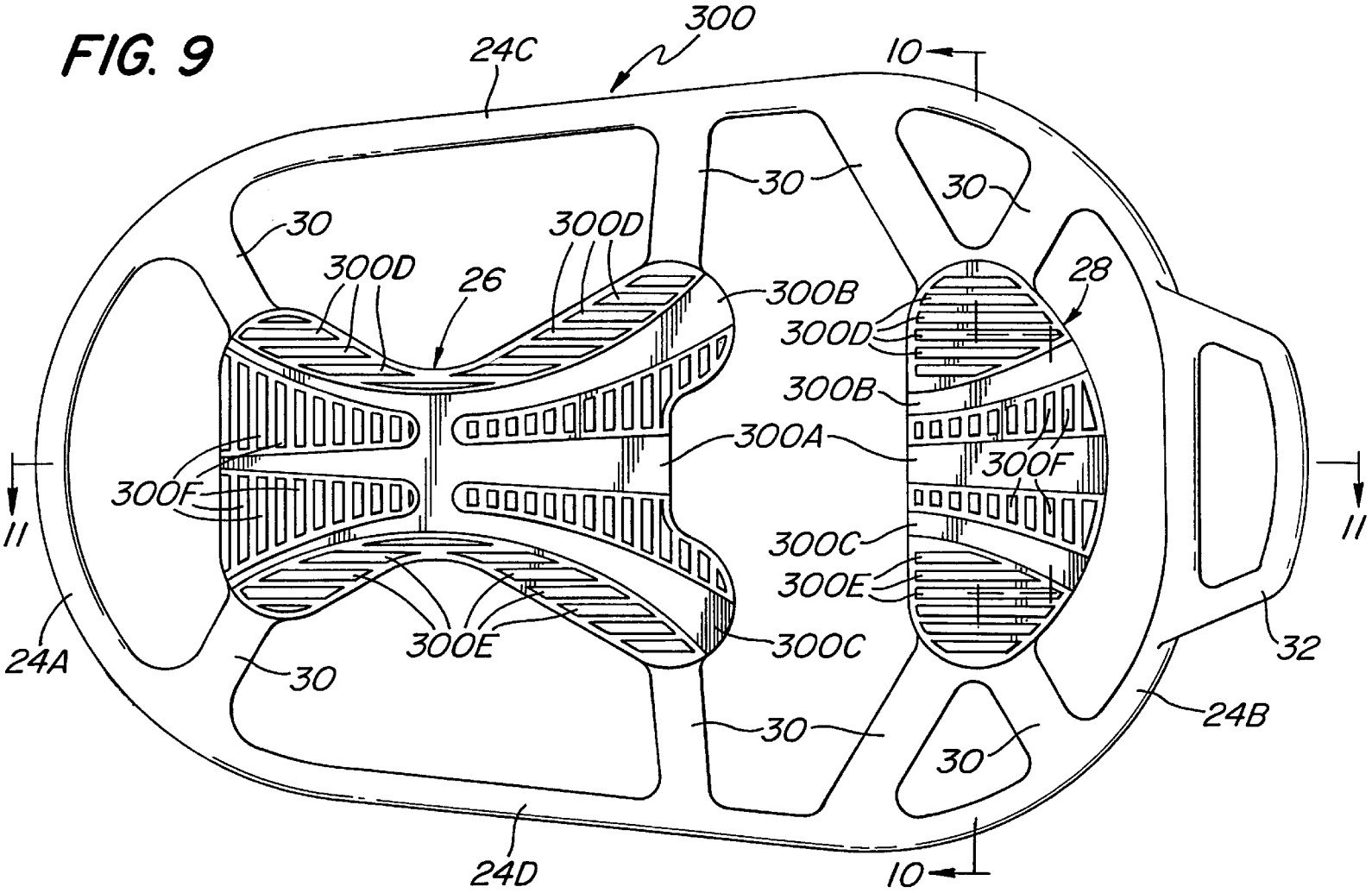
FIG. 9 is a plan view of another alternative embodiment of the attachment device of this invention, the attachment device including recesses or grooves to enhance traction in wet or sloppy conditions.
Figure 10:
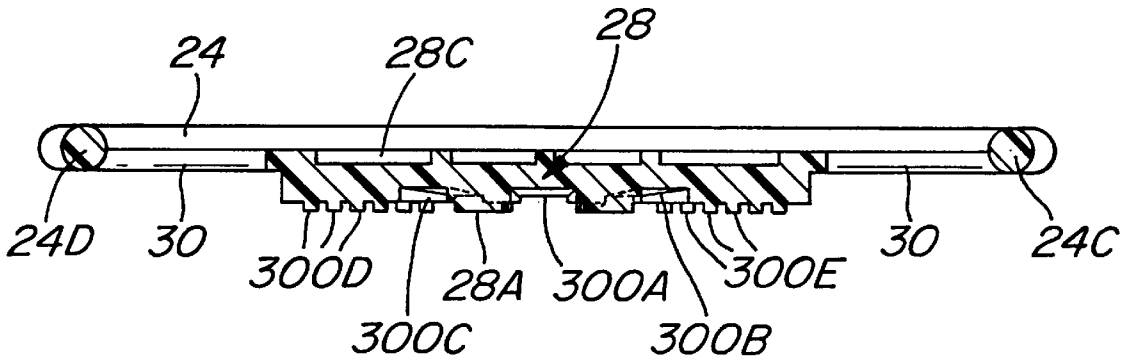
FIG. 10 is a sectional view taken along line 10—10 of FIG. 9.
Figure 11:
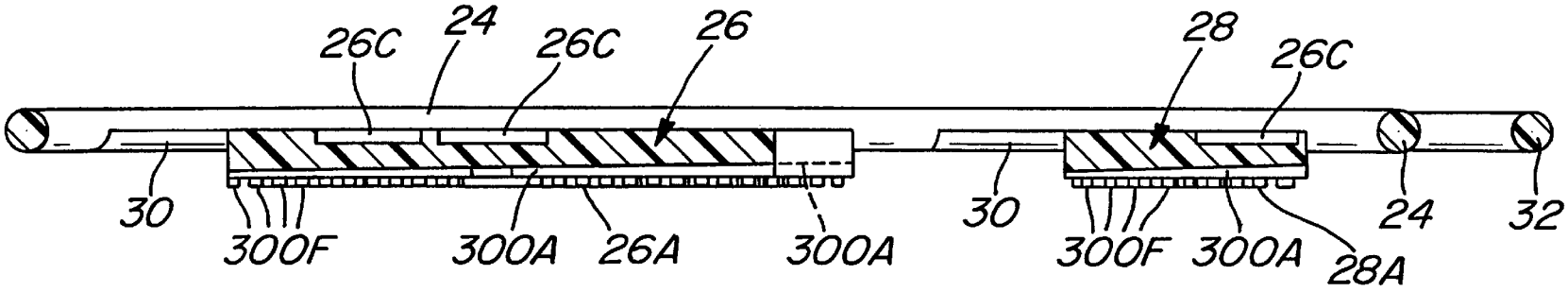
FIG. 11 is an enlarged sectional view taken along line 11—11 of FIG. 9.

Referring now to various figures of the drawing where like reference numerals refer to like parts there is shown at 20 in FIG. 1, a footwear attachment device constructed in accordance with this invention for securement to any type of conventional footwear 22, e.g., a boot, having a sole 22A and an upper 22B, to render the it resistant to slippage on slippery surfaces. The embodiments of the attachments shown in FIGS. 3–6 are suitable for enhancing traction on all but the slipperiest conditions, e.g., smooth ice. For those severe slippery conditions, the attachment devices of this invention preferably include plural cleats including ice-piercing spikes, such as those in the embodiment of FIG. 7. The embodiment of the attachment device shown in FIGS. 9–11 is particularly suited for providing slip resistance on wet surfaces and/or artificial sports surfaces. In some applications, it may be desired to provide a different level of enhanced traction than would otherwise be provided by the attachment device itself. Thus, for these applications at least one optional friction-enhancing pad may be releasably secured to portions of the ground engaging surfaces of the attachment device.

It must be pointed out at this juncture that the subject invention is not limited to footwear attachment devices for enhancing traction. Thus, footwear attachment devices contemplated by this invention can be configured to decrease traction, rather than increase it. Such traction reduction may be desirable for various applications. For example, a traction reducing footwear attachment device in accordance with this invention may be provided to mount onto a conventional shoe to convert it to one suitable for use in bowling.

Figure 2:
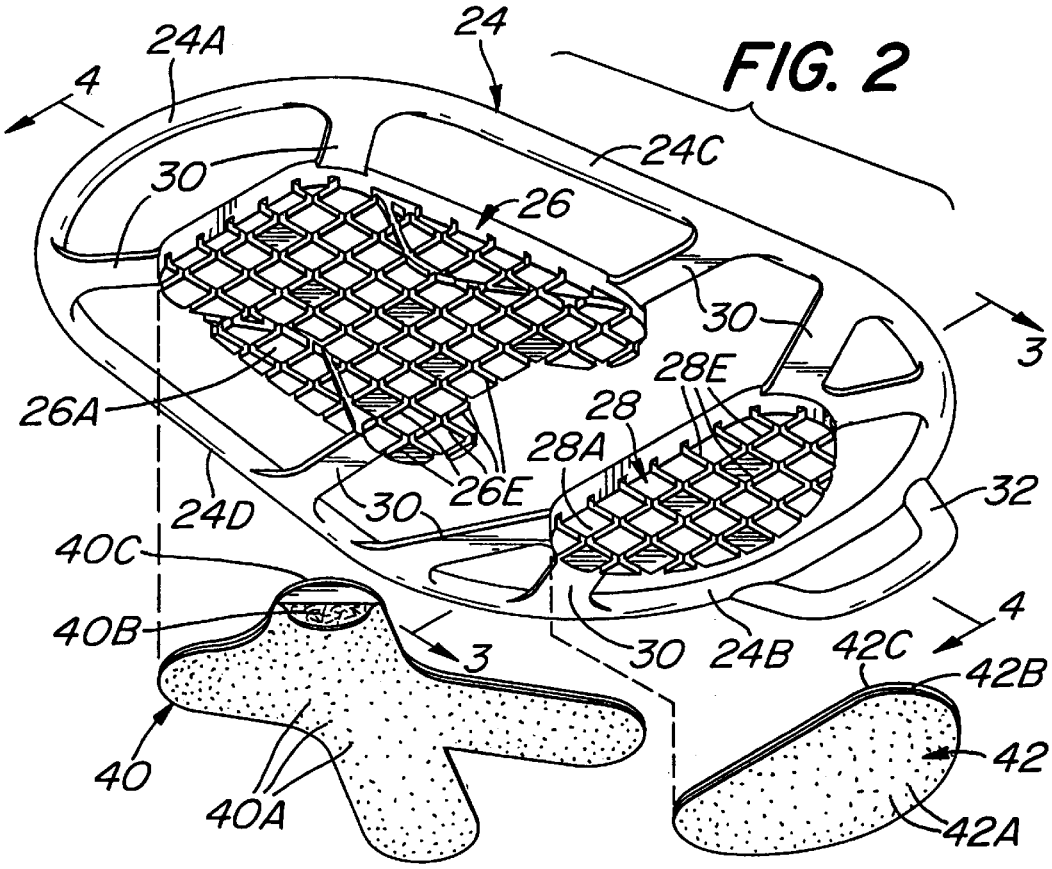
FIG. 2 is an enlarged exploded isometric view of the embodiment of the attachment device of FIG. 1 shown in its compact, generally flat state prior to mounting on the footwear, this view also showing a pair of optional traction enhancing pads arranged for releasable securement to the attachment device.

As will be described in detail later each embodiment of the attachment devices of this invention is preferably formed (e.g., molded) as a one-piece or unitary member of a flexible and resilient material, e.g., rubber, PVC, TPR etc., in the interests of manufacturing simplicity and economy. Moreover, each attachment device is constructed so that it normally assumes a generally flat, compact configuration when not in use in the interest of ease of storage and/or transportation, but can be readily stretched into a non-planar shape for mounting onto the article of primary footwear on which it is to be worn. To that end, as can be seen in FIG. 2 the attachment device 20 basically comprises a generally planar member comprising a mounting ring portion 24, a forefoot-sole portion or pad 26, a heel-sole portion or pad 28, and plural connecting webs 30, all molded as an integral or one-piece member. In accordance with one preferred aspect of the invention the device 20 also includes an integral pull-tab 32.

The ring 24 is an annular member of a generally flattened oval shape, having an arcuate front or toe section 24A, an arcuate rear or heel section 24B, and two generally linear side sections 24C and 24D interconnecting the ends of the toe and heel sections 24A and 24B, respectively. The cross section of the ring portion 24 is circular (See FIGS. 3 and 4). In one preferred embodiment the length of the ring, i.e., the distance between the forwardmost portion of the toe section 24A and the rear most portion of the heel section 24B is approximately 10 inches (25.4 cm.), the width of the ring between the side sections 24C and 24D at the point where they merge with the arcuate toe section 24A is approximately 5 inches (12.7 cm.), and the width of the ring between those sections where they merge with the arcuate heel section 24B is approximately 6 inches (15.2 cm). These dimensions, coupled with the fact that the material forming the ring is resilient, enables the ring 24 to be readily stretchable to accommodate various common sizes of primary footwear 22.

The thinness of the connecting webs 30 enables them to stretch readily with the ring 24 to facilitate the mounting and dismounting of the attachment device 20 onto various sizes of primary footwear. The pads, in contradistinction, are preferably sufficiently thick to provide resistance to stretching and stability to the device. In addition the thickness of the pads provides additional cushioning and/or shock absorption over that provided by the primary footwear.

The forefoot-sole portion or pad 26 is a generally planar member of irregular, but longitudinally symmetrical shape. The pad 26 includes an outer, ground engaging surface 26A, and an inner surface 26B. In accordance with one preferred aspect of this invention the thickness of the pad 26, i.e., the distance between its inner and outer surfaces, is at least equal to and preferably slightly greater than the diameter of the cross section of the ring 24. In the interests of weight reduction plural cavities or pockets 26C (FIG. 4) are molded in the upper surface 26B of the pad 26. The forefoot-sole pad 26 is located within the ring 24 in the area bounded by the front section 24A and the contiguous side sections 24C and 24D and is held in place in that position at the front by two connecting webs 30. The pad 26 is held in this position at the rear by another two connecting pads. Each of the webs 30 is an elongated linear strip which is of significantly lesser thickness than the diameter of the cross sectional area of the ring 24 and the thickness of the forefoot-sole portion 26 to enable the connecting webs to stretch and flex readily (as is important in order to mount and hold the device in proper place on the primary footwear). For example, the diameter of the cross section of the ring is approximately 0.25 inch (6.35 mm), the thickness of each web is approximately 0.125 inch (3.2 mm), and the thickness of the pad 26 is approximately 0.32 inch (8 mm). The heel-sole pad 28 is also a generally planar member of approximately semi-circular shape and of the same thickness as the forefoot-sole pad 26. The heel-sole pad 28 also includes a ground engaging outer surface 28A and an inner surface 28B having pockets 28C, and is mounted within the ring 24 in the area bounded by the rear section 24B and the contiguous side sections 24C and 24D by the remainder of the connecting webs 30 in the same manner as the forefoot-sole portion 26 is mounted to the ring. The thickness of the pad 28 is the same as the pad 26.

As shown in FIG. 1 the mounting ring 24 of the device 20 is arranged to be stretched to encircle the upper of the primary footwear with the heel section 24B of the ring engaging the heel counter of the primary footwear, while the toe section 24A of the ring engages the upper at the toe portion of the upper. The side sections 24C and 24D extend along the sides of the upper in the upper's arch and contiguous regions. The pull tab 32 is provided to aid in pulling the ring onto the primary footwear upper, and when the device 20 is in place like shown in FIG. 1 the tab extends upward behind the primary footwear heel counter.

The ground engaging surfaces 26A and 26B of the device 20 may be constructed so that they are identical or different, depending upon the desired application for the attachment. Moreover, those surfaces may be of any desired type to provide whatever type of traction is desired. For example, if it is desired that the attachment device be utilized for general slippery conditions the surfaces 26 and 28 may include plural intersecting grooves 26E and 28E, respectively, to define a large number of square, e.g., 0.375 inch (9.5 mm), ridges therebetween. The grooves/ridges provide good traction on all but the iciest conditions. For such icy conditions, the ground engaging surfaces 26A and 26B preferably include ice-penetrating spikes, as will be described later with reference to the embodiments of FIGS. 7, 8, 13 and 14.

Figure 3:
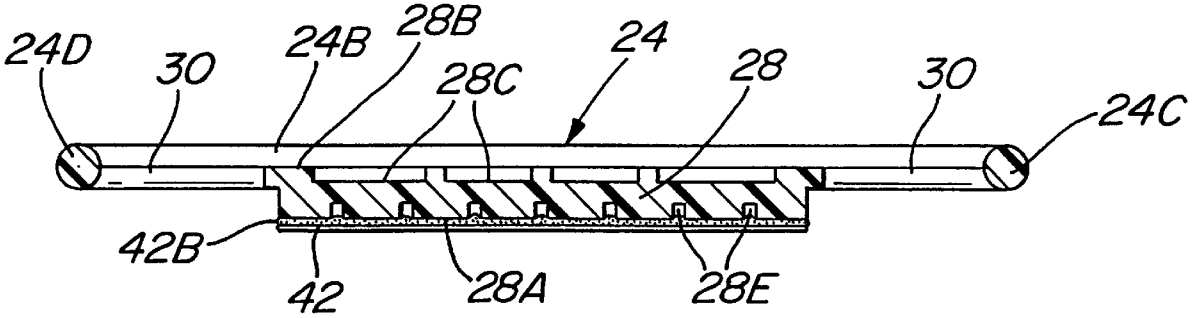
FIG. 3 is an enlarged sectional view taken along line 3—3 of FIG. 2.
Figure 4:
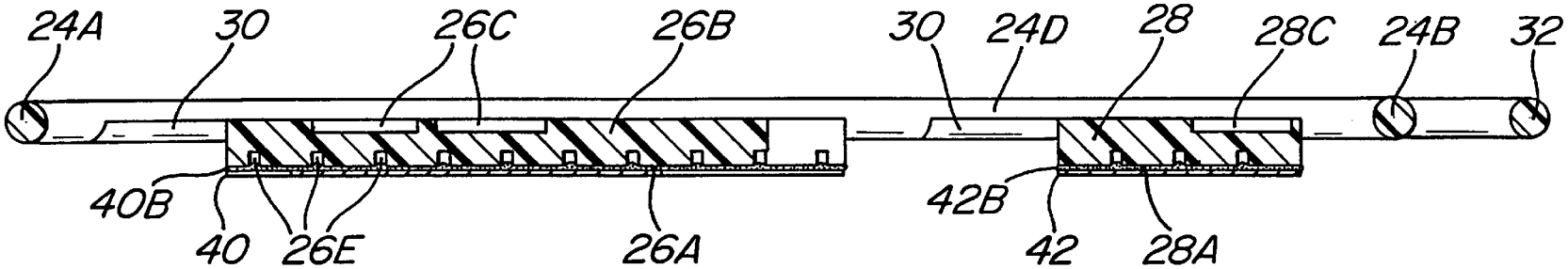
FIG. 4 is an enlarged sectional view taken along line 4—4 of FIG. 2 and showing the optional traction enhancing pads releasably secured to the attachment device.

If it is desired to provide resistance to slippage on wet and/or slushy surfaces, the ground engaging surfaces 26A and 26B may include various flared grooves as will be described later with reference to FIGS. 9–11. If it is desired to provide general slip resistance, while also providing water resistance to the article of primary footwear, the attachment device may also include a thin barrier wall between the connecting webs and pads, as will be described later with reference to FIGS. 5 and 6. If even more slip resistance is desired than that provided by the ground-engaging portions of the attachment devices of FIGS. 1–6 and 9–14, one or more optional friction-enhancing pads may be provided for releasable securement on the ground engaging pads of the attachment devices as shown in FIGS. 2–4. Each of these optional friction-enhancing pads is preferably constructed in accordance with the teachings of copending U.S. patent application, Ser. No.: 09/018810, filed on Feb. 4, 1998, entitled Traction-Altering Pads For Adhesive Releasable Securement On Footwear, and whose disclosure is incorporated by reference herein, and which is assigned to the same assignee as this invention.

In the interest of brevity all of the details of those pads will not be reiterated herein. Suffice it to state that as shown in FIG. 2 two such friction enhancing pads, 40 and 42 are shown. Each of these pads is preferably a disposable member formed of a sheet of any suitable material, e.g., paper, having a multitude of abrasive particulates 40A fixedly secured to the outer surface thereof. For example, the sheet may be formed of conventional sand paper or emery paper. In any case the sheet has a releasable pressure sensitive adhesive 40B on the side opposite the gritted side 40A. Other materials can be used to form the sheet, so long as the material is somewhat flexible and suitable for having a releasable pressure sensitive adhesive secured on one side and a plurality of sharp particulates or grit on the opposite side. In order to protect the pressure sensitive adhesive prior to attachment to the device 20 a removable cover sheet 40C is provided.

As can be seen in FIG. 2 the friction enhancing optional pad 40 is of generally X-shape and is arranged to be releasably secured to the outer surface 26A of the attachment device's pad 26 after the cover sheet 40C has been removed. The attachment device's pad 26 includes a peripheral groove of generally X-shape defining the boundary in which the optional friction enhancing pad 40 is to be located and releasably secured. The optional pad 42 is similar to pad 40 in that it includes a gritted surface 42A, an adhesive surface 42B and a removable cover sheet 42C. However, the optional pad 42 is of generally semi-circular shape for releasable mounting on the outer surface of attachment device's heel pad 28.

Figure 5:
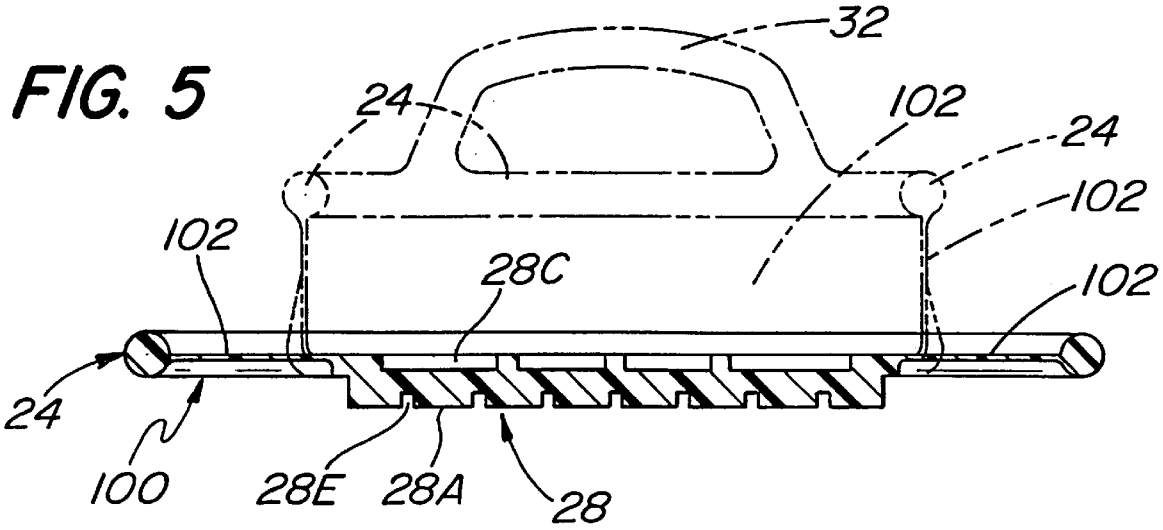
FIG. 5 is view similar to FIG. 3 but showing an alternative embodiment of the attachment device of this invention to provide additional traction and water protection for the primary footwear, with the phantom lines in this figure depicting the peripheral edge portions of the attachment device bent upward in the operative position to secure the attachment device in place on an article of footwear.
Figure 6:
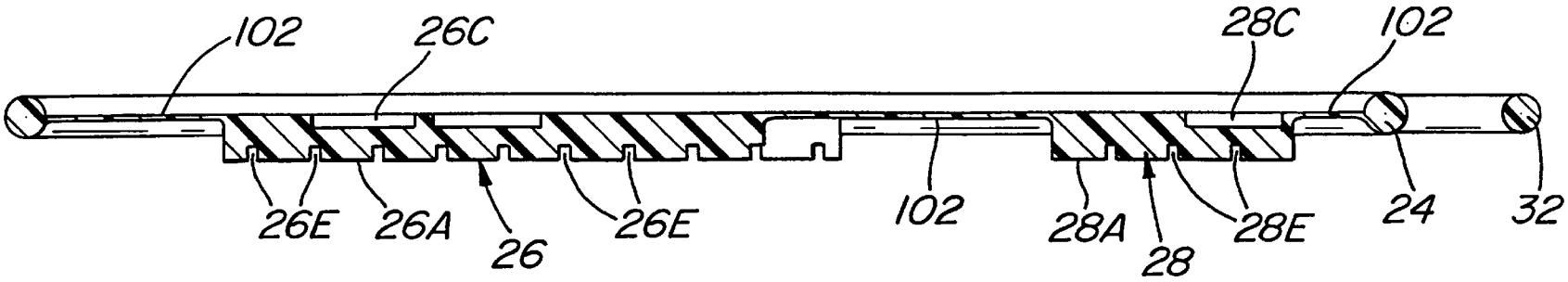
FIG. 6 is a view similar to FIG. 4 but of the embodiment of FIG. 5.

In FIGS. 5 and 6 there is shown an embodiment of an attachment device 100 which is similar in construction to the embodiment of FIGS. 1–4, but in addition provides a moisture barrier to protect the primary footwear from water, slush or other liquids which may be encountered when wearing the attachment device. In the interest of brevity the common features of the attachment device 100 with the attachment device 20 will be given the same reference numbers and the details of their construction and function(s) will not be reiterated. Thus, as can be seen in FIGS. 5 and 6 the attachment device 100 includes the heretofore identified ring 24, pads 26 ad 28, connecting webs 30, and tab 32. In addition, it includes a very thin web or sheet 102 in all of the spaces between the ring 24, the connecting webs 30, the forefoot pad 126 and the heel pad 28. Thus, when the attachment device 100 is in place on the primary footwear, as shown by the phantom lines in FIG. 5, the thin web or sheet 102 in combination with the pads, the connecting web and the ring will provide a fluid impervious barrier to any liquid from the bottom of the primary footwear and along portions of the upper contiguous with the sole and heel up to the location of the ring 24 on that upper.

Figure 7:
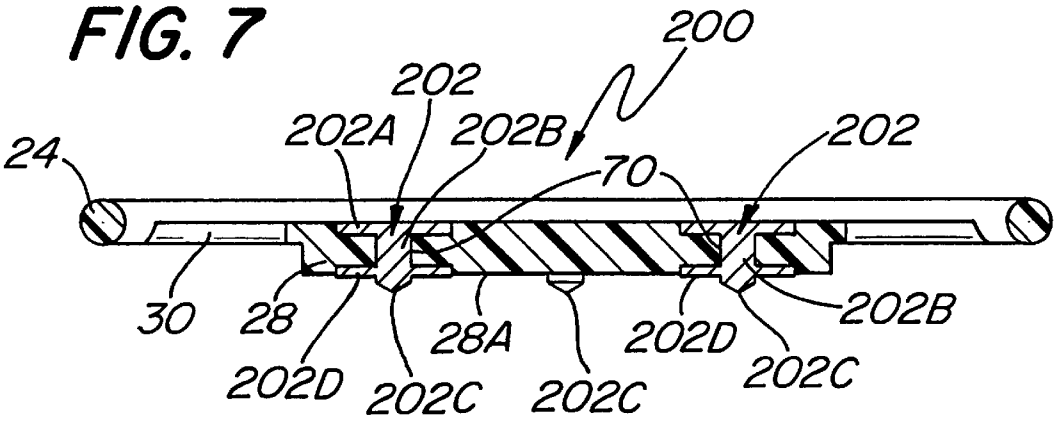
FIG. 7 is a sectional view, similar to FIG. 3, but showing another alternative embodiment of the attachment device of this invention, i.e., an attachment device including plural spikes or cleats suitable for providing resistance to slippage on ice or hardpacked snow.
Figure 8:
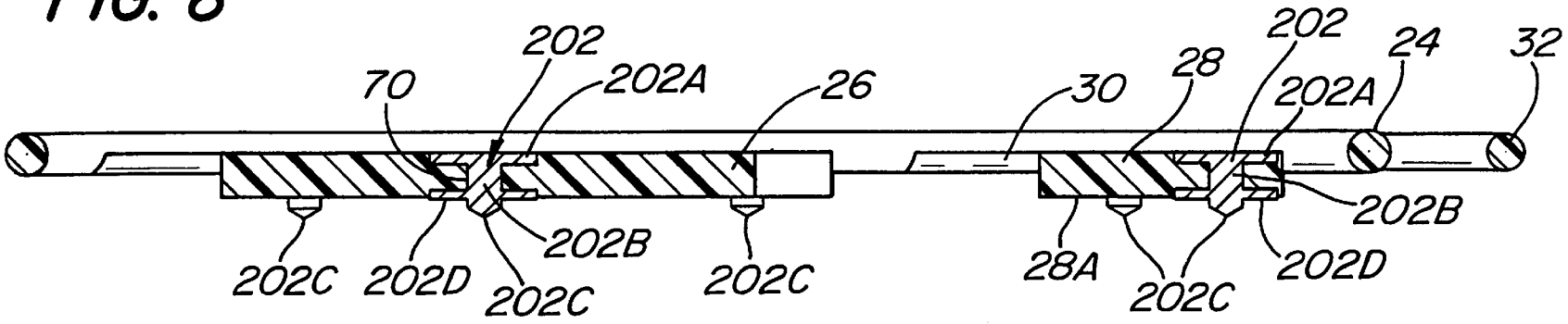
FIG. 8 is a sectional view, similar to FIG. 4, but showing the alternative embodiment of the attachment device of FIG. 7.

In FIGS. 7 and 8 there is shown an embodiment of an attachment device 200 particularly suited for use in very icy conditions. Again the interests of brevity the common features of the attachment device 200 with the attachment device 20 will be given the same reference numbers and the details of the construction and function(s) of those features will not be reiterated. Thus, as can be seen in FIGS. 7 and 8 the pads 26 and 28 each include plural cleats 202. The pads 26 and 28 may include the plural grooves like those described earlier or may include other shaped grooves, or no grooves at all. In any case each of the cleats comprises a hard material, e.g., steel, spike of rivet-like construction. In particular, each cleat includes a disk-like plate 202A from which a central pin or spike 202B projects. The free end 202C of the spike 202B is pointed. A disk 202D is arranged to be connected to the spike slightly to the rear of the pointed free end. Each cleat 202 is arranged to be secured to the associated ground engaging pad of the attachment device 200 by extending the spike through an aperture 70 provided in the pad, e.g., pad 26 or 28, so that the inner plate 202A engages the inside surface of the pad contiguous with the aperture 70, as shown in FIG. 7. The spike is of sufficient length so that its pointed free end 202C extends beyond the outer surface 26A or 28A of the pad in which it is mounted. The disk 202D is disposed on the free end of the spike to sandwich the material making up the pad contiguous with the aperture 70 between the inner plate 202A and the disk 202D. If desired, an annular recess may be provided in the outer surface 26A or 28A of the pad 26 or 28, respectively, contiguous with the aperture 70 to receive the disk 202D therein.

As should be appreciated by those skilled in the art when the attachment device 200 is in place on the primary footwear and the user walks over icy surfaces the pointed free ends of the cleats will dig into the ice to provide very good traction.

In FIGS. 9–11 there is shown an embodiment of an attachment device 300 which is similar in construction to the embodiment of FIGS. 1–4, except for the ground engaging surfaces of the pads 26 and 28. The attachment device 300 is arranged to provide excellent traction in wet conditions, e.g., where there may be water, slush or other liquids which may be encountered on the ground when wearing the attachment device. In the interests of brevity the common features of the attachment device 300 with the attachment device 20 described above will be given the same reference numbers and the details of their construction and function(s) will not be reiterated. Thus, as can be seen in FIGS. 9–11 the attachment device 300 includes the heretofore identified ring 24, pads 26 and 28, connecting webs 30, and tab 32. The outer surface of the pad 26 includes a central longitudinally extending groove 300A which flares in width from the front to the rear of the pad. Flanking the central groove 300A are a pair of grooves 300B and 300C which are mirror images of each other. Each of these grooves is of arcuate shape and flares in width from the front to the rear of the pad. Each of the grooves 300A–300C preferably increases in depth (flares) from front to rear. However, it is contemplated that the grooves 300A–300C be of uniform depth from front to rear, if desired.

A plurality of linear longitudinally extending grooves are located in the area between the groove 300B and the adjacent outer edge of the pad 26 to form plural elongated, longitudinally extending ridges 300D. Similarly a plurality of linear longitudinally extending grooves are located in the area between the groove 300C and the adjacent outer edge of the pad 26 to form plural elongated, longitudinally extending ridges 300E in that area. A plurality of transversely extending grooves are located in the areas between the groove 300B and 300C to form plural elongated, transversely extending ridges 300F.

The outer surface of the pad 28 includes similar features to the pad 26. Thus pad 28 includes a central longitudinally extending groove 300A which flares in width and depth from the front to the rear of the pad. The width of the groove 300A at the front of the pad 28 is just slightly smaller than the width of the groove 300A at the rear of the pad 26, but substantially greater than the width of the groove 300A at the front of the pad 26. Flanking the central groove 300A are a pair of grooves 300B and 300C which are mirror images of each other. Each of these grooves is of arcuate shape and flares in width and depth from the front to the rear of the pad. The width of the grooves 300B and 300C at the front of the pad 28 is just smaller than the width of the grooves 300B and 300C at the rear of the pad 26, but larger than the width of those grooves at the front of the pad 26. A plurality of linear longitudinally extending grooves are located in the area between the groove 300B and the adjacent outer edge of the pad 26 to form plural elongated, longitudinally extending ridges 300D. Similarly a plurality of linear longitudinally extending grooves are located in the area between the groove 300C and the adjacent outer edge of the pad 26 to form plural elongated, longitudinally extending ridges 300E in that area. A plurality of transversely extending grooves are located in the areas between the groove 300B and 300C to form plural elongated, transversely extending ridges 300F.

As should be appreciated by those skilled in the art the shape of the grooves 300A, 300B and 300C, e.g., the flaring of the grooves in width and depth from front to rear, facilitates the ejection of liquid or soft adherent materials therefrom. In particular, these grooves serve to channel or direct any liquid or other soft material, e.g., slush, mud, etc., which may enter the grooves to flow down their length to freely exit the open rear end thereof. Thus, as the user walks any soft material, e.g., snow, slush, mud, etc., which would tend to adhere within the grooves 300A–300C is, instead, forced or ejected out (i.e., is enabled to flow from the narrower and shallower front portion of the grooves into the wider and deeper rear portions of the grooves and out the open end of the grooves).

The longitudinally extending ridges 300D and the transversely extending ridges serve to prevent lateral, particularly outward lateral, and longitudinal sliding of the attachment device over some types of slippery surfaces, e.g., artificial sport surfaces. The transversely extending ridges (and the grooves therebetween) facilitate the flexure of the attachment during normal walking, while providing additional ground-engagement, traction enhancing action.

Figure 12:
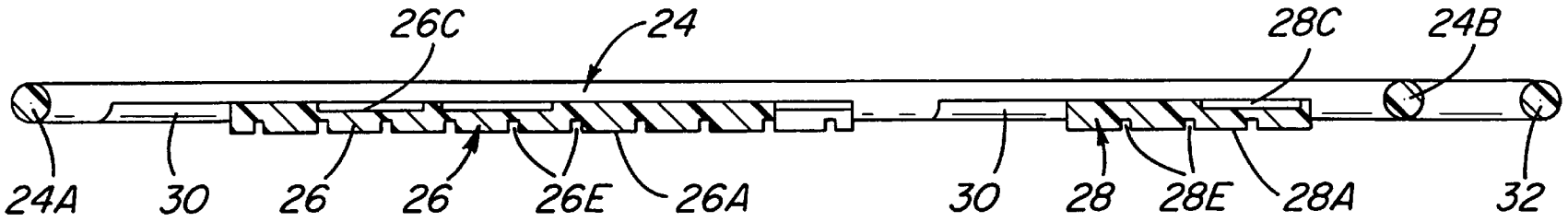
FIG. 12 is a sectional view similar to FIG. 6, but showing yet another alternative embodiment of an attachment device of this invention, e.g., a disposable device for providing enhanced traction.
Figure 22:
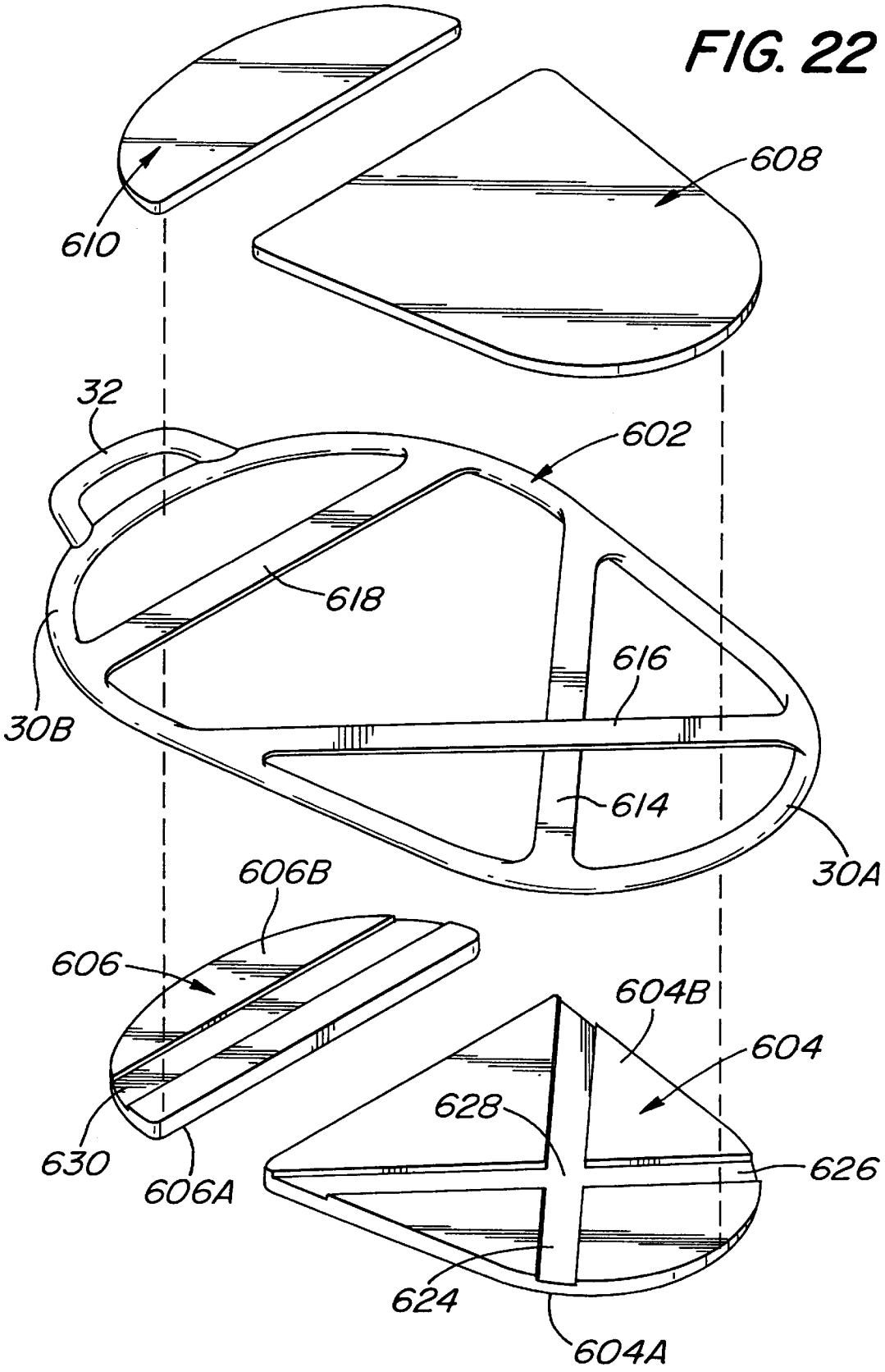
FIG. 22 is an exploded isometric view of the device of FIG. 13.

In FIG. 12 there is shown an alternative embodiment 500 of an attachment device constructed in accordance with this invention. The device 500 is similar to the attachment device 20, except that it is designed to be disposable. Thus, the pads 26 and 28 are made significantly thinner in the device 500 than in the device 20.

If desired the footwear attachment devices of this invention may be constructed to include alternative ice-engaging members, e.g., spikes, than those disclosed above. In particular, each of the spikes may be formed as a cleat assembly in accordance with the teachings of a copending U.S. patent application Ser. No. 09/026,352, filed on Feb. 19, 1998, entitled Cleats For Footwear, whose disclosure is incorporated by reference herein and which is assigned to the same assignee as this invention.

It should also be pointed out that while it is preferable to mold the attachment devices of FIGS. 1–12 as an integral unit from a single material (with portions of different thicknesses to provide the desired amount of stretchability in the ring and the connecting webs—and with minimal stretching of the pads), it is contemplated that the attachment devices can be molded of different materials, having different resiliency, hardness, etc., for the various parts of the devices, as desired. Moreover, for some applications it may be desirable to form the attachment device of several components and to assemble them into a unit.

While the attachment devices described heretofore are resistant to displacement on the footwear, in some particularly strenuous activities additional means, e.g., laces, VELCRO® straps, etc. (not shown), may be provided for additional stability. Such straps or laces may be connected to the attachment device at any desirable position, e.g., by means of tabs (not shown), located directly opposite the attachment points of the forefoot pad 26 to the outer ring 24 and/or the attachment points of the heel pad 28 to the outer ring 24.

In FIGS. 13–22 there is shown another alternative embodiment of an attachment device 600 constructed in accordance with this invention. The device 600 is particularly suited for use in applications requiring a better fit for the device on the primary footwear and resistance to accidental displacement or dismounting. The device 600 is similar in many respects to the devices described heretofore except that it is not formed as an integral unit. In particular, the device 600 basically comprises at least three components, a mounting member, at least one base pad member and at least one cover pad member. In the embodiment shown in FIGS. 13–22 there are two base pad members and two cover pad members, making a total of five components. In particular, the device 600 shown in FIG. 13 comprises a mounting member 602, a forefoot base pad member 604, a heel base pad member 606, a forefoot cover pad member 608, and a heel cover pad member 610. As will be described in detail later the forefoot base pad member 604 and the forefoot cover member 608 member are arranged to be secured together, thereby forming an forefoot pad assembly located in the forefoot region (to be described) of the attachment device. In a similar manner, the heel base pad member 606 and the heel cover member 610 member are arranged to be secured together, thereby forming an heel pad assembly located in the heel region (to be described) of the attachment device.

The mounting member 602 is an integral unit including a mounting ring portion 612, plural connecting web portions 614, 616, and 618 extending between respective opposed portions of the mounting ring 612, and an integral pull-tab 32 (like that described earlier). The mounting ring 612 is identical in construction to the of the device 20 described above and includes a forefoot region 620 (FIG. 14) and a heel region 622 (FIG. 14). The webs 614 and 616 are located in the forefoot region 620, while the web 618 is located in the heel region 622. The mounting member 602 is preferably molded as an integral unit of the same material(s) as that making up the device 20 described above.

As can be seen the ring 612 is an annular member of a generally flattened oval shape, having an arcuate front or toe section 30A, an arcuate rear or heel section 30B, and two generally linear side sections 30C and 30D interconnecting the ends of the toe and heel sections 30A and 30B, respectively. The cross section of the ring portion 30 is circular. In one preferred embodiment the length of the ring, i.e., the distance between the forward-most portion of the toe section 30A and the rear most portion of the heel section 30B is approximately 10 inches (25.4 cm.), the width of the ring between the side sections 30C and 30D at the point where they merge with the arcuate toe section 30A is approximately 5 inches (12.7 cm.), and the width of the ring between those sections where they merge with the arcuate heel section 30B is approximately 6 inches (15.2 cm). These dimensions, coupled with the fact that the material forming the ring is resilient, enables the ring 30 to be readily stretchable to accommodate various common sizes of primary footwear 22.

The mounting ring 612 includes a longitudinal central axis 36, with the portion of the interior of the ring on either side of the central axis adjacent the toe section 30A forming the heretofore identified forefoot region 620, and with the portion of the interior of the ring on either side of the central axis adjacent the heel section 30B forming the heretofore identified heel region 622.

The webs 614 and 616 are each elongated, linear straps which extend between respective portions of the ring 612 in the forefoot region. Each of the straps 614 and 616 extends at approximately 45 degrees to the longitudinal axis 36 and they cross over each other at that axis. If desired, the straps may be connected or joined to each other at their cross-over point, e.g., may be integrally molded together at the cross-over point or adhesively secured together at the crossover point. In the embodiment shown the two straps merely overlie each other and are not connected to each other at the cross-over point. This arrangement enables each strap to stretch independently of the other, for reasons to become apparent later.

The web 618 is also an elongated linear strap. However, strap 618 extends transversely to the longitudinal axis 36 between respective portions of the ring 612 in the heel region 622.

The straps 614–618 are each of the same thickness and width as the webs 30 described heretofore with reference to attachment device 20. If desired, the straps 614–618 may be thinner and/or narrower to enable each to stretch even more readily. Turning now to FIGS. 13, 17, 18, 19 and 22, it can be seen that the forefoot base pad member 604 is a generally planar member which may be formed of the same material as that of the mounting member 602 or may be formed of any other suitable somewhat flexible slip resistant material. In addition the base pad 604 may be shaped and sized similarly to the forefoot sole pad 24 described heretofore or may be of some other shape so long as it can fit within the forefoot region 620. In any case the forefoot base pad member 604 includes an outer or ground engagement surface 604A, which may be formed and/or constructed like any of the ground engaging surfaces described above. The inner surface 604B of the forefoot base pad member 604 includes a pair of linear recesses 624 and 626 which intersect each other. Each recess is of a size, shape and depth to accommodate a respective one of the straps 614 and 616 therein. In particular, the recess 624 is arranged to accommodate the strap 614, while the recess 626 is arranged to accommodate the strap 616. Each recess is preferably of a depth at least equal to the thickness of the strap to be located therein. Moreover, the depth of each recess at the crossover point 628 is preferably twice the thickness of the other portions of the intersecting recesses and tapers to and from that increased depth portion in each recess. The increased depth portion at the crossover point of the recesses 624 and 626 ensures that the overlying strap portions do not bind upon each other where they cross over when the attachment device is fully assembled. Such binding could potentially impede the independent stretchability of the straps 614 and 616. The remaining portions of each recess, being at least equal to the thickness of the strap to be located therein, ensures that that strap portion does not bind in the recess when the attachment device is fully assembled. Such binding action could potentially impede the stretchability of the straps with respect to the recess in which it is located and hence the stretchability with respect to the forefoot base pad 604.

The heel base pad 606 is also a generally planar member which may be formed of the same material as that of the mounting member 602 or may be formed of any other suitable somewhat flexible slip resistant material. In addition the base pad 606 may be shaped and sized similarly to the heel sole pad 26 described heretofore or may be of some other shape so long as it can fit within the heel region 622. Like the forefoot base pad member 604, the heel base pad member 606 includes an outer or ground engagement surface 606A, which may be formed and/or constructed like any of the ground engaging surfaces described above. The inner surface 606B of the heel base pad member 606 includes a single transversely extending linear recess 630. The recess 630 is of a size, shape and depth to accommodate the strap 618 therein, e.g., the recess is preferably of a depth at least equal to the thickness of the strap 618 so that the strap 618 does not bind therein when the attachment device 600 is assembled.

Referring now to FIGS. 13,20,21 and 22 the details of the forefoot cover pad 608 and the heel cover pad 610 will now be considered. Each cover pad is preferably a generally planar member which may be formed of the same material as that of the mounting ring member 602 or may be formed of any other suitable somewhat flexible material. The forefoot cover pad 608 is preferably shaped and sized similarly to the forefoot base pad 604, but can be of some other shape and size so long as it can fit within the forefoot region 620 and will cover a substantial portion of the surface 604B of the forefoot base pad 604. In a similar manner the heel cover pad 610 is preferably shaped and sized similarly to the heel base pad 606, but can be of some other shape and size so long as it can fit within the heel region 622 and will cover a substantial portion of the surface 606B of the heel base pad 606. Thus, the forefoot cover pad 608 includes an inner base pad engagement surface 608B for abutting the surface 604B of the forefoot base pad 604, while the heel cover pad 610 includes an inner base pad engagement surface 610B for abutting the surface 606B of the heel base pad 606. In order to secure the cover pads in place on their respective base pads an adhesive or some other securement means can be used.

It should be pointed out that the recesses for accommodating the straps of the ring member may be located in the cover pads and not in the base pads. Further still, both the cover pads and the base pads may include recesses so that when the base pads and cover pads are secured together their recesses conjoin to passageways for accommodating the respective straps of the ring member therein.

If desired, the securement of the cover pads to the base pads with the straps interposed therebetween may be releasable and not permanent. For example the cover pads and base pads may be releasably connected together via threaded connectors, snap connectors, VELCRO® connectors, etc., to enables the footwear attachment device 600 to be readily disassembled, a feature which can be of significant value to the user, e.g., it enables the device to be converted for use in various applications requiring different types of ground engagement surfaces. In particular, the attachment device 600 with releasably securable cover and base pads can be configured so as to make use of base pads including spikes or cleats for use in ice or snow. When it is desired to convert that attachment device for use on wet surfaces which would be susceptible to spike-induced damage, all that is required is to disassemble the cover pads from the base pads, replace the spiked base pads with ones without spikes but having features resistant to slippage on wet surfaces, then reconnect the cover pads over the replacement base pads so that the device is ready for use on the primary footwear.

As will be appreciated by those skilled in the art, since the depth of each of the recesses in the pad assemblies is sufficient to readily accommodate the straps of the mounting ring member without binding when the cover pads are secured in place over the base pads, each strap can stretch or move within its respective recess. This independent stretchability facilitates the mounting and fitting of the attachment device 600 onto the primary footwear 22, e.g., the straps can stretch quite readily with respect to the ring 602, thus holding the pads 604 and 606 in position under the sole and heel of the primary footwear, while the ring 606 tightly engages the upper of the primary footwear to be resistant to slippage thereoff. Moreover, and quite significantly, the independent stretchability of the straps with respect to the pads and the mounting ring 602 tends to keep the attachment device securely in place on the primary footwear, even under strenuous or other adverse usage conditions, e.g., applications where the attachment device may be subjected to high repeated degrees of flexure, such as could occur when climbing, running, etc.

As should be appreciated from the foregoing the attachment devices of this invention are simple in construction and can be fabricated readily (and in the case of the embodiments of FIGS. 13–22, assembled readily). Moreover, they are compact so that they can be conveniently stored or transported until ready for use, e.g., a worker can carry the attachments either flat or rolled up in his/her pocket. When it is desired to use the devices, all that is necessary is to stretch the ring and the associated web connectors or straps to place the ring on the upper of the footwear on which the attachment device is to be worn. The pull tab can be used to facilitate the mounting of the attachment device on the footwear. Once in place the device is resistant to displacement on the footwear and offers great stability and resistance to slippage on wet, icy, snowy, muddy or other slippery condition. Further still, the shape and construction of the ground-engaging pads can be tailored to any particular environment or application to provide increased or decreased traction, as desired.

Without further elaboration the foregoing will so fully illustrate our invention that others may, by applying current or future knowledge, adopt the same for use under various conditions of service.

What is claimed is:

1. A footwear attachment device for releasable mounting on a primary footwear to provide a desired type of traction, the primary footwear having an upper and a sole including a forefoot portion and a heel portion, said attachment device comprising a mounting member, at least one base pad member and at least one cover pad member, said mounting member being an integral unit including a mounting ring and plural connecting webs extending between selected portions of said ring, at least one of said base pad member and said cover pad member including at least one recess therein for receipt of a respective one of said connecting webs, said cover pad member being arranged to be secured over said base pad member, with said respective one of said connecting webs being interposed between said base pad member and said cover pad member and being stretchable within said recess, one of said pad members having an inner surface and the other of said pad members having a ground engaging surface, said ring being stretchable to enable said ring to encircle the upper of the primary footwear to releasably mount the attachment device thereon, with said inner surface of one of said pad members being disposed in engagement with a portion of the sole of the primary footwear, and with said ground engaging surface being exposed for providing a desired type of traction.

2. The attachment device of claim 1 wherein said base pad member and said cover pad member are formed of a generally planar sheet of flexible material.

3. The attachment device of claim 2 wherein said pad members are located at the forefoot portion of the sole of the primary footwear.

4. The attachment device of claim 2 wherein said pad members are located at the heel portion of the sole of the primary footwear.

5. The attachment device of claim 1 wherein said device includes a heel region and a forefoot region, and wherein said connecting webs comprise at least one heel strap located in said heel region and a pair of forefoot straps located in said forefoot region, each of said pair of forefoot straps having an end, said pair of forefoot straps extending between respective portions of said ring, said at least one heel strap extending between respective portions of said ring.

6. The attachment device of claim 5 wherein said pad members are located at said forefoot region.

7. The attachment device of claim 5 wherein said pad members are located at said heel region.

8. The attachment device of claim 5 wherein said pad members comprise a forefoot base pad member, a heel base pad member, a forefoot cover pad member and a heel cover pad member, said forefoot base pad member having a pair of recess therein for receipt of respective ones of said pair of forefoot straps, said forefoot cover member being arranged to be secured to said forefoot base pad member with said pair of forefoot straps interposed therebetween and stretchable within said recesses, said heel base pad member having at least one recess therein for receipt of said at least one heel strap, said heel cover member being arranged to be secured to said heel base pad member with said heel strap interposed therebetween and stretchable within said recess.

9. The attachment device of claim 8 wherein each of said pad members is a generally planar member, with one of said forefoot pads having an inner surface and the other of said forefoot pads having a ground engaging surface, with one of said heel pads having an inner surface and the other of said heel pads having a ground engaging surface, said ring being stretchable to enable said ring to encircle the upper of the primary footwear to releasably mount the attachment device thereon, with said inner surface of said one of said forefoot pad members being disposed in engagement with the forefoot portion of the sole of the primary footwear, with said inner surface of said one of said heel pad members being disposed in engagement with the heel portion of the sole of the primary footwear, said ground engaging surface of said forefoot pad and said heel pad being exposed for providing a desired type of traction.

10. The attachment device of claim 1 wherein said ring is an annular member of a generally flattened oval shape having an arcuate front section, an arcuate rear section, and two generally linear side sections interconnecting respective ends of the front and rear sections.

11. The attachment device of claim 9 wherein said ring is an annular member of a generally flattened oval shape having an arcuate front section, an arcuate rear section, and two generally linear side sections interconnecting respective ends of the front and rear sections.

12. The attachment device of claim 1 additionally comprising a pull-tab.

13. The attachment device of claim 1 wherein said ground engaging surface includes plural grooves therein.

14. The attachment device of claim 1 wherein said grooves are flared.

15. The attachment device of claim 14 wherein attachment device includes a longitudinal axis and wherein said grooves are generally oriented so that portions extend along said axis from front to rear of said attachment device and wherein at least selected ones of said grooves increase in cross sectional area from front to rear.

16. The attachment device of claim 15 wherein said selected grooves flare in width from front to rear.

17. The attachment device of claim 15 wherein said selected grooves flare in depth from front to rear.

18. The attachment device of claim 16 wherein said selected grooves flare in depth from front to rear.

19. The attachment device of claim 1 wherein said attachment device includes a longitudinal axis and wherein said ground engaging surface includes plural grooves therein, with selected ones of said grooves extending generally parallel to said longitudinal axis and with selected others of said grooves extending transversely to said axis.

20. The attachment device of claim 1 wherein said ground engaging surface includes plural cleats projecting therefrom.

21. The attachment device of claim 1 wherein said ground engaging surface includes plural flexible ridges projecting therefrom.

22. The attachment device of claim 21 wherein said attachment device includes a longitudinal axis and wherein at least selected ones said ridges are elongated members which extend generally parallel to said axis.

23. The attachment device of claim 21 wherein said attachment device includes a longitudinal axis and wherein at least selected ones said ridges are elongated members which extend generally transverse to said axis.

24. The attachment device of claim 21 wherein said attachment device includes a longitudinal axis and wherein at least selected ones said ridges are elongated members which extend generally parallel to said axis and at least other selected ones said ridges are elongated members which extend generally transverse to said axis.

25. The attachment device of claim 24 wherein said ground engagement surface includes additional grooves, said additional grooves being generally oriented so that portions extend along said axis from front to rear of said attachment device and wherein at least selected ones of said additional grooves increase in cross sectional area from front to rear.

26. The attachment device of claim 25 wherein said selected grooves flare in width from front to rear.

27. The attachment device of claim 25 wherein said selected grooves flare in depth from front to rear.

28. The attachment device of claim 26 wherein said selected grooves flare in depth from front to rear.

29. The attachment device of claim 1 wherein said at least one recess is located in said base pad member.

* * * * *